United States Patent [19]

Marega et al.

[11] Patent Number: 4,962,594

[45] Date of Patent: Oct. 16, 1990

[54] ADJUSTMENT DEVICE OF THE FLEXIBILITY FOR SKI BOOTS

[75] Inventors: Antonello Marega, Montebelluna, Italy; Peter Knights, Sharon, Vt.; Pierluigi Lorati, Ponte di Legno, Italy

[73] Assignee: Calzaturificio Tecnica SpA, Treviso, Italy

[21] Appl. No.: 376,654

[22] Filed: Jul. 7, 1989

[30] Foreign Application Priority Data

Jul. 7, 1988 [IT] Italy ..... 21270 A/88
Nov. 28, 1988 [IT] Italy ..... 22212/88[U]

[51] Int. Cl.[5] ..... A43B 5/04
[52] U.S. Cl. ..... 36/117; 36/170
[58] Field of Search ..... 36/117, 118, 119, 120, 36/121

[56] References Cited

U.S. PATENT DOCUMENTS

| | | | |
|---|---|---|---|
| 3,936,959 | 2/1976 | Hanson et al. | 36/119 X |
| 4,372,061 | 2/1983 | Pozzobon | 36/117 |
| 4,391,049 | 7/1983 | Parisotto | 36/120 X |
| 4,523,395 | 6/1985 | Borsoi | 36/119 |
| 4,620,377 | 11/1986 | Pozzebon | 36/119 |
| 4,669,203 | 6/1987 | Sartor | 36/120 |

FOREIGN PATENT DOCUMENTS

| | | | |
|---|---|---|---|
| 316605 | 5/1989 | European Pat. Off. | 36/117 |

*Primary Examiner*—Paul T. Sewell
*Assistant Examiner*—Andrew D. Meyers
*Attorney, Agent, or Firm*—Griffin, Branigan & Butler

[57] ABSTRACT

A slider, adjustably and slidably inserted in the V shaped rear slit of the ski boot shell permits the forward flexibility of the ski boot to be adjusted.

16 Claims, 11 Drawing Sheets

Fig. 4
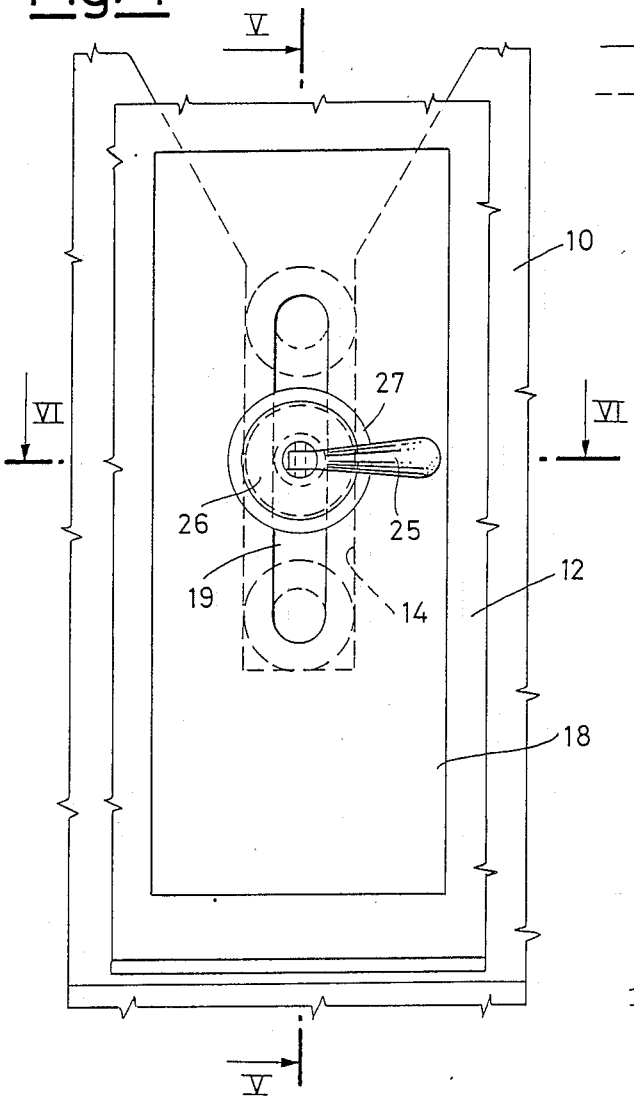
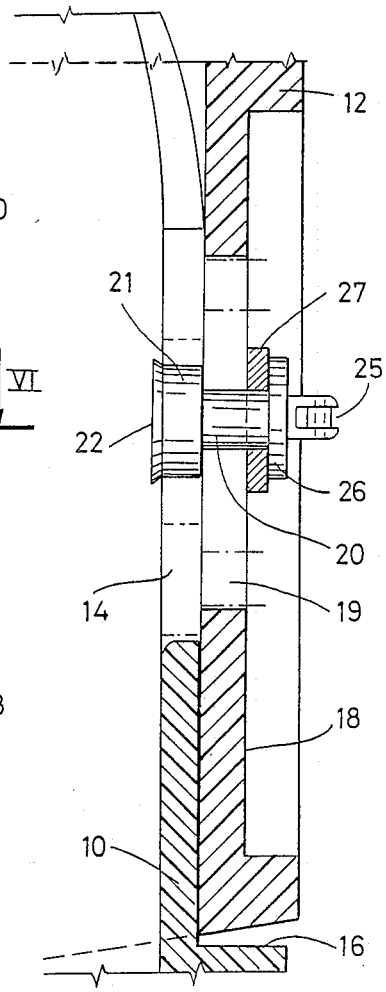
Fig. 5
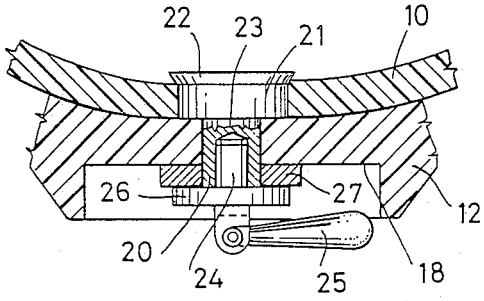
Fig. 6

Fig.11
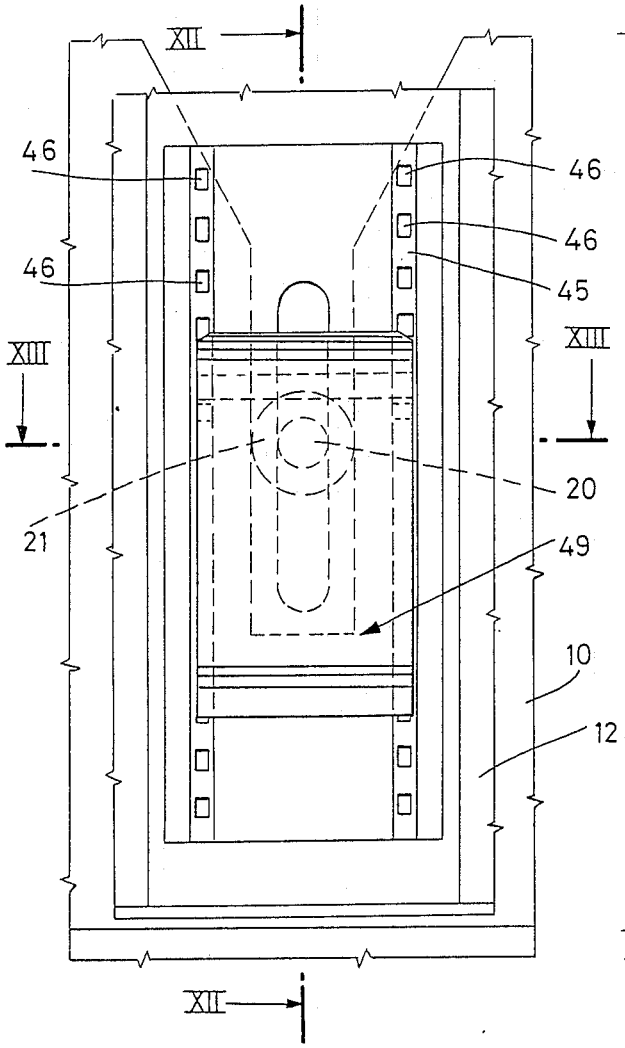
Fig.12
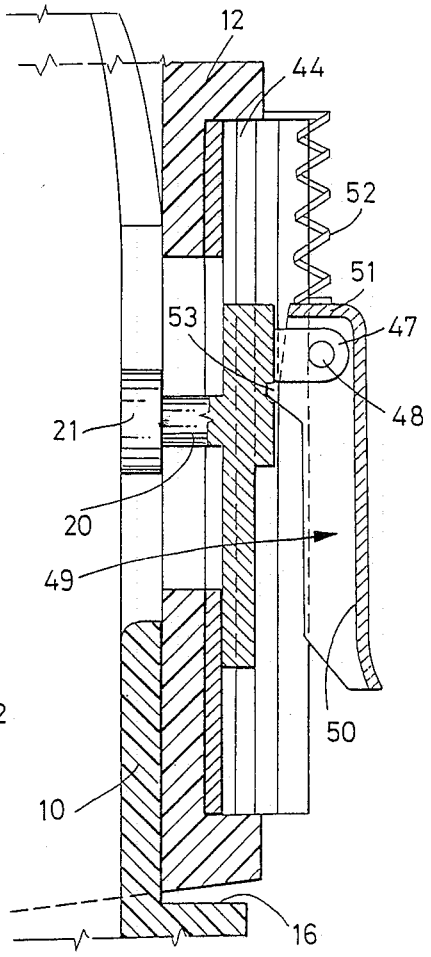
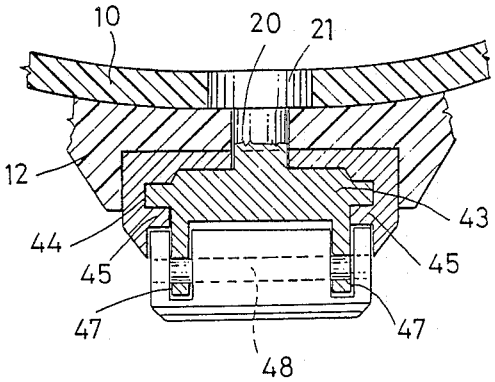
Fig.13

Fig.16
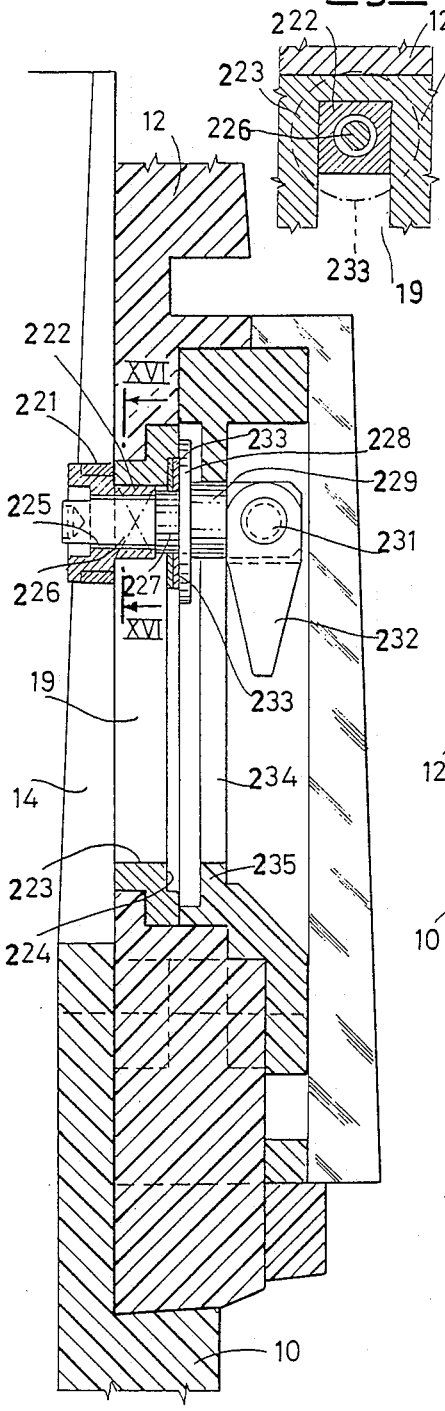
Fig.15
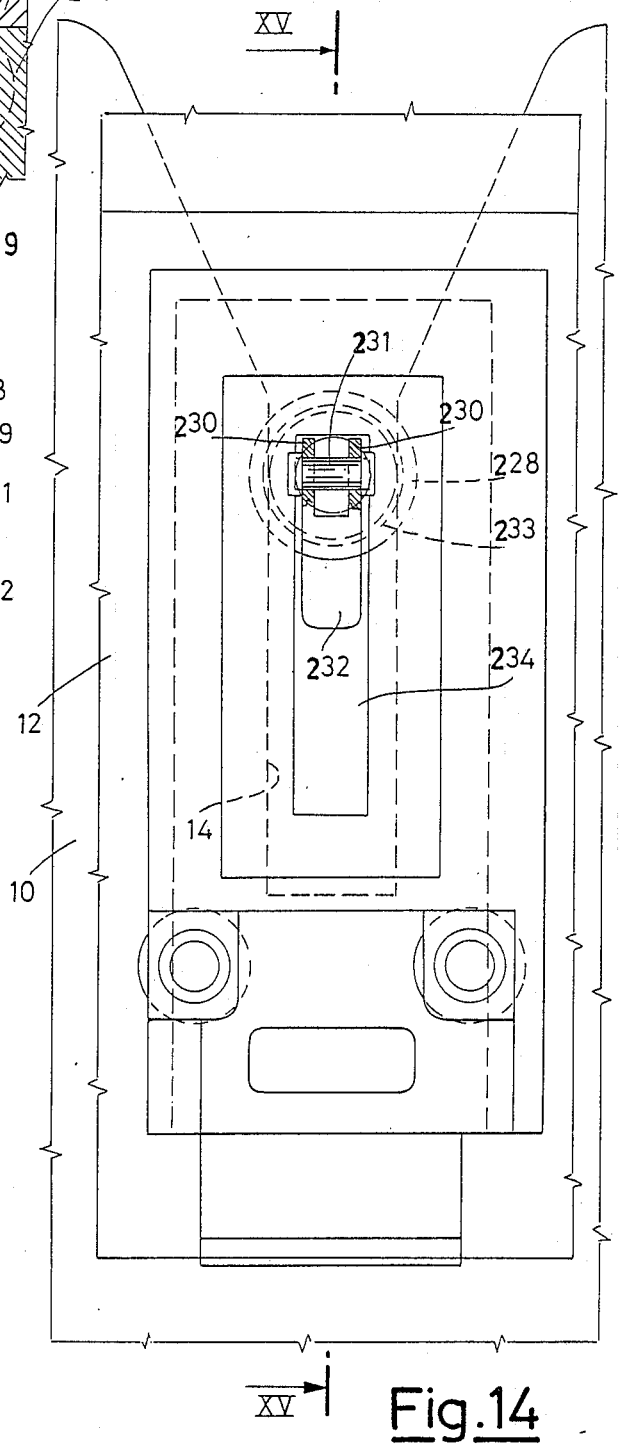
Fig.14

ADJUSTMENT DEVICE OF THE FLEXIBILITY FOR SKI BOOTS

The present invention relates to an adjustment device for ski boots and more specifically for the adjustment of the flexibility in the forward direction of the leg portion of the shell of the ski boot.

Since a number of years the ski boots are manufactured from essentially rigid plastic materials and comprise a shell having a sole, to which a leg portion is hinged through the latter with the foot being introduced into a padded inner lining shoe, already placed within the shell.

This leg portion is normally vertically divided so as to permit it to be locked around the leg, little above the ankle, as well as to be open to permit the introduction of the foot, the locking taking place by means of suitable buckles or hooks. In the rear part of the shell there is often formed a V shaped vertical slit.

When the leg is fowardly bent, thus forcing onto the leg portion of the boot, the edges of the slit approach each other, with the self-evident drawbacks. On the one hand as a matter of fact, the strains generated by the flexibility are discharged in a localized manner, with a resulting sacrifice of the fatigue strength of the material (such a feature being not negligeable, especially if account is taken of the fact that the ski boot must per se be at used at very low temperatures, certainly lower then 0° C.).

On the one hand, the adherence of the whole foot put within the inner lining shoe of the shell and consequently the transmission of the commands from the leg and from the foot to the ski are less prompt and precise.

To the above considerations there must be also added that a constant tendency in the recent year has been and is that of adequately coupling the foot-boot to the skill of the skier. This condition obviously must occur also as regards the forward flexibility of the leg portion. The purpose of the present invention is that of essentially solving in an industrially advantageous manner the problems and drawbacks as above briefly mentioned.

A particular purpose of the present invention is that of providing a device which permits the forward flexibility of the leg portion of the boot to be adjusted.

These purposes are achieved by means of a device for the adjustment of the forward flexibility of the leg portion in a ski boot comprising an essentially rigid shell and a leg portion, the shell being reawardly provided with a essentially V shaped slit open in the upper part, characterized by comprising a slider member housed in said V shaped slit and vertically displaceable so as to adjust the degree of reciprocal approachment of the two edges of said slit when the leg portion is forwardly bent.

According to a preferred embodiment of the device according to the present invention a slider is provided which comprises a pin passing through said V shaped slit and connected to a vertically movable slide by being screw thread engaged with an externally actuatable screw, whereby its rotation causes the displacement of the slide and therewith of the pin or slider, keeping the two edges of the slit in an wide apart open condition.

It is self-evident that the closer is the slider to the closed end of the V shaped slit, the greater shall be the degree of reciprocal approachment of the two edges of the slit and thus the greater shall be the forward flexibility of the ski boot.

According to a second embodiment of the device according to the invention said slider is connected to a lever or eccentric e.g. cam, movable between an unlocked position, in which said slider can be manually displaced along said V shaped slit, and a locked position in which also said slider is locked in the desired adjustment position.

According to a further embodiment the device comprises a pin crosswise positioned with respect to the rear vertical center line of the leg portion, having the ends anchored to the leg portion so as to be rotatable around it axis, said pin having associated thereto with a screw and ratchet connection two blocks symmetrically positioned with respect to the said center line and cooperating with edges of said V shaped slit of the shell to obtain the desired adjustment, said pin being moreover actuatable for rotation around its axis by control means.

More specifically said blocks are inserted between the two edges of said V shaped slit, whereby the removal of said blocks causes a corresponding displacement of said edges overcoming the natural elasticity and giving place to the desired adjustment.

The peculiar features and advantages of the present invention shall more clearly appear from the following description, related to the accompanying drawings in which:

FIG. 4 is a rear view of the adjustment device of the invention according to a first embodiment;

FIGS. 5 and 6 are cross section views according to the line V—V and VI—VI of FIG. 4;

FIG. 11 is a view like FIG. 4 of a third embodiment of the invention; and FIGS. 12 and 13 are cross section views according to the lines XII—XII and XIII—XIII of FIG. 11;

FIG. 14 is a view like FIG. 4 of a variation of the embodiment of FIG. 4, FIGS. 15 and 16 are cross section views respectively according to the lines XV—XV and XVI—XVI of FIG. 14;

Figure 1:
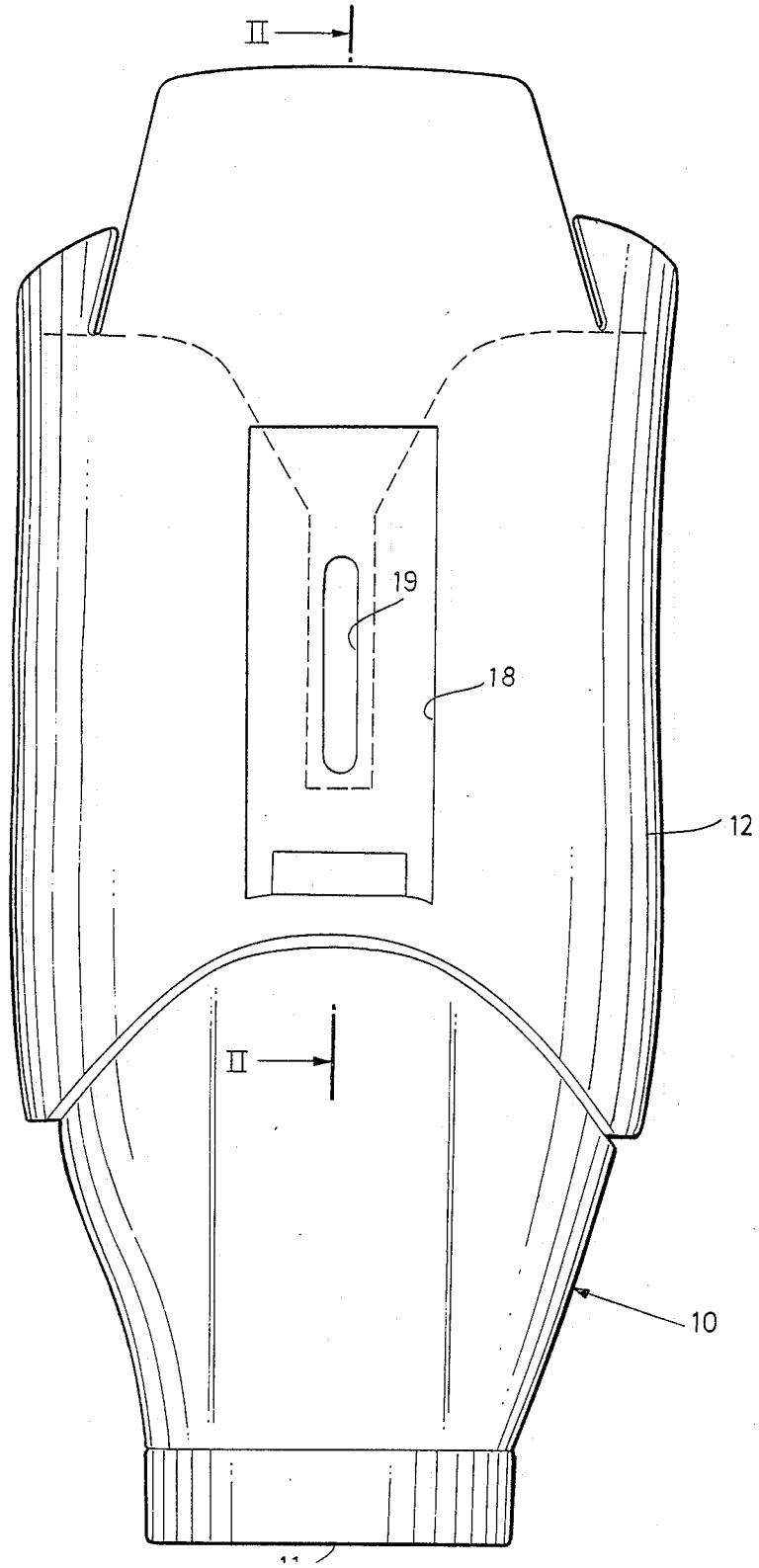
FIG. 1 is a rear view of the shell and of the leg portion of the boot from which the adjusting device of the invention has been dismounted.
Figure 2:
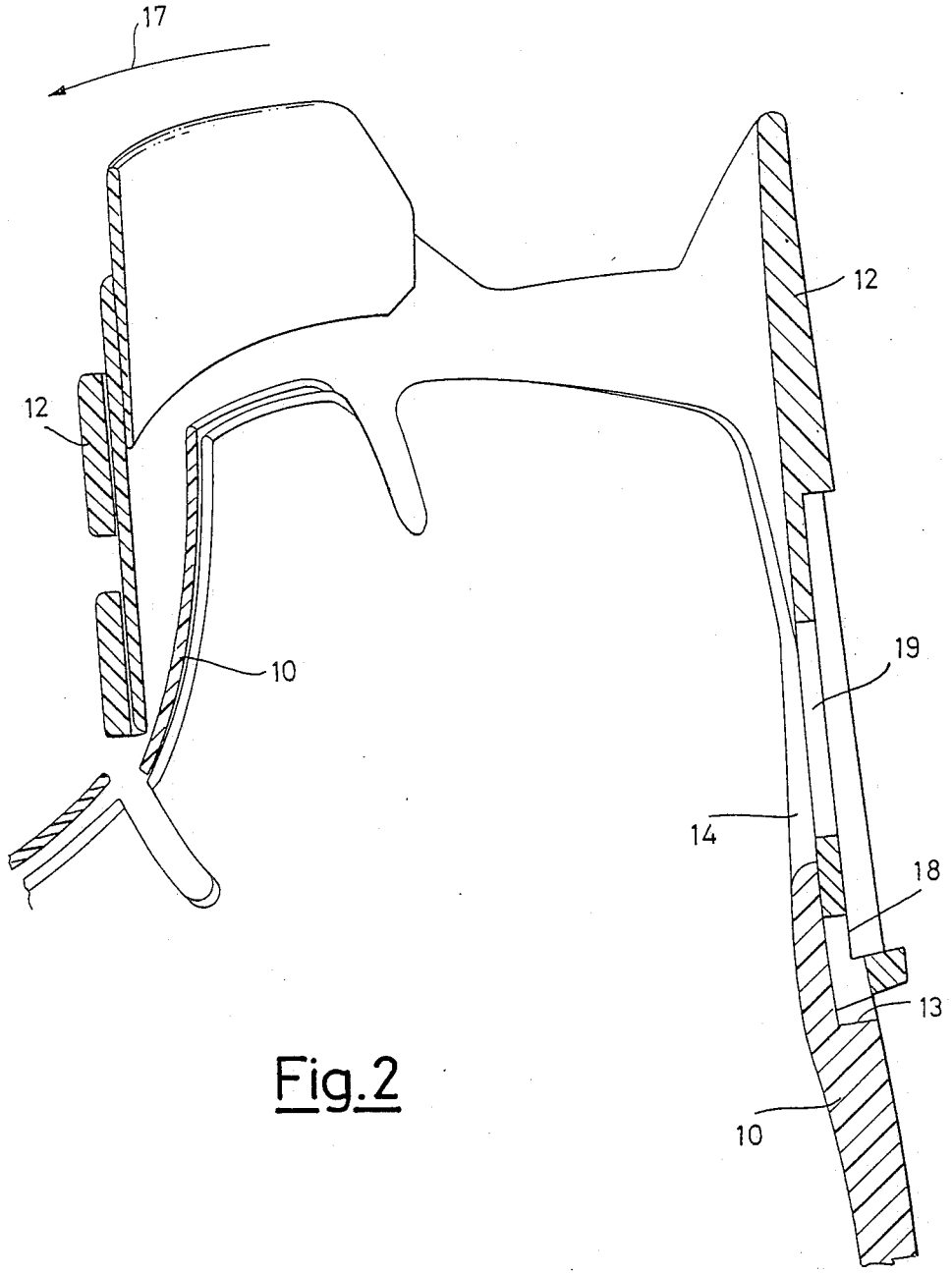
FIG. 2 is a cross section view according to the lines II—II of FIG. 1.
Figure 3:
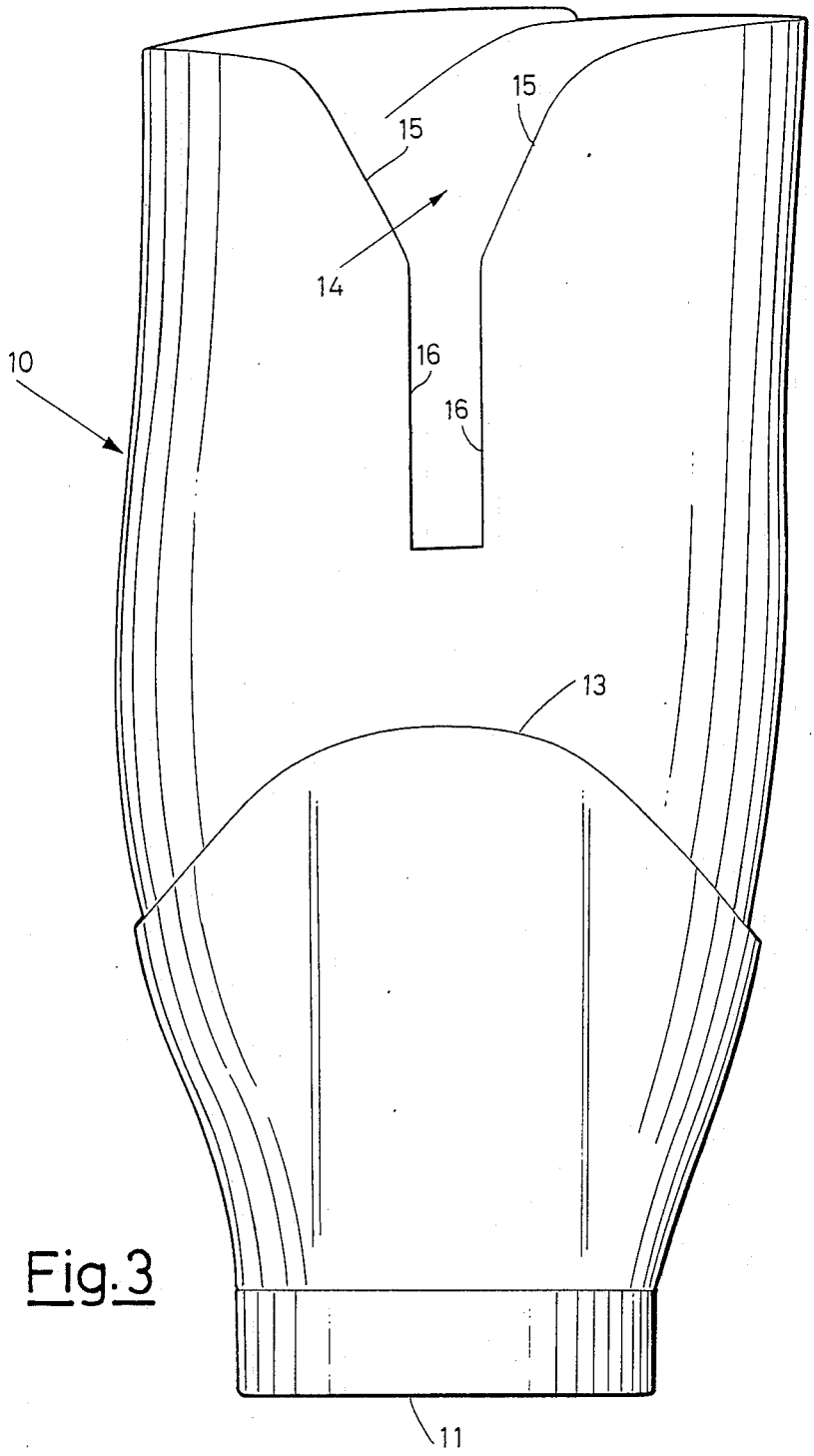
FIG. 3 is a view of the shell alone, without leg portion.
Figure 7:
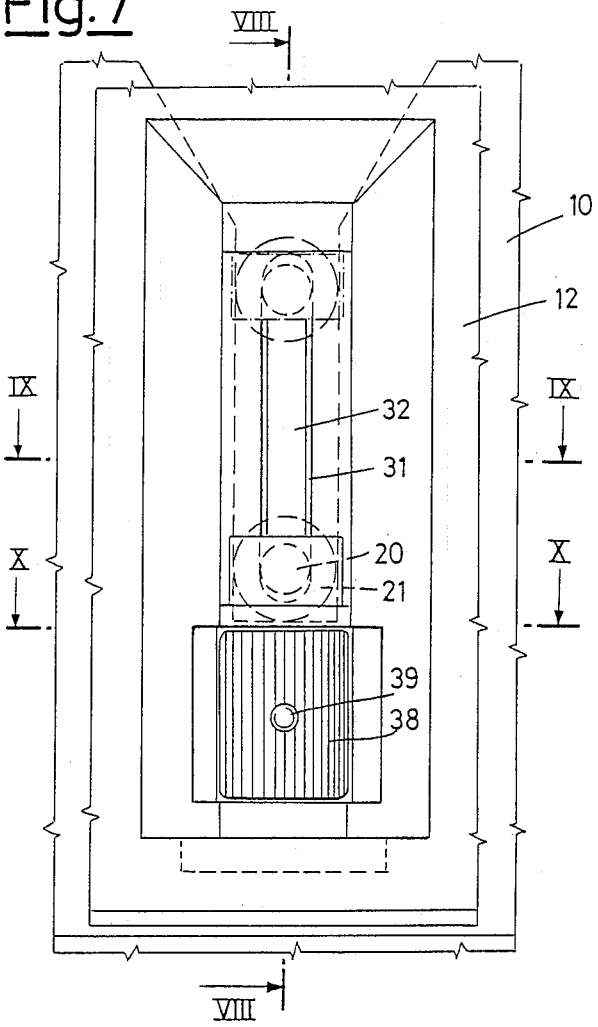
FIG. 7 is a view like FIG. 4 of a further and preferred embodiment of the invention.
Figure 8:
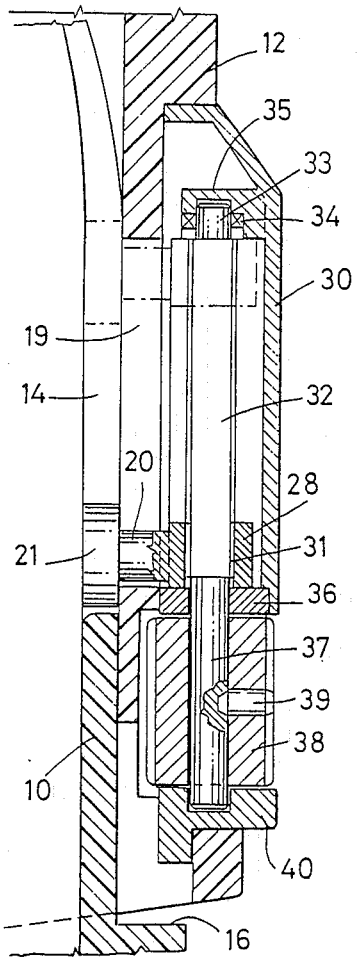
FIGS. 8, 9 and 10 are cross section views according to the lines VIII—VIII, IX—IX and X—X of FIG. 7.
Figure 9:
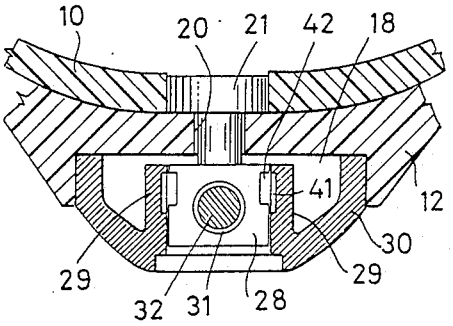
Figure 10:
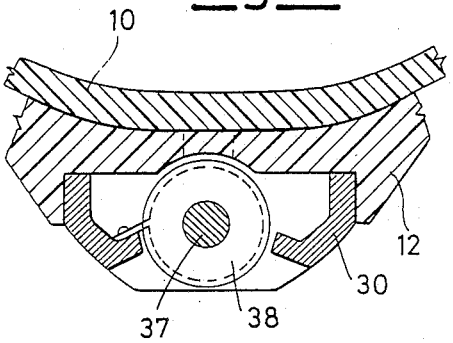
Figure 17:
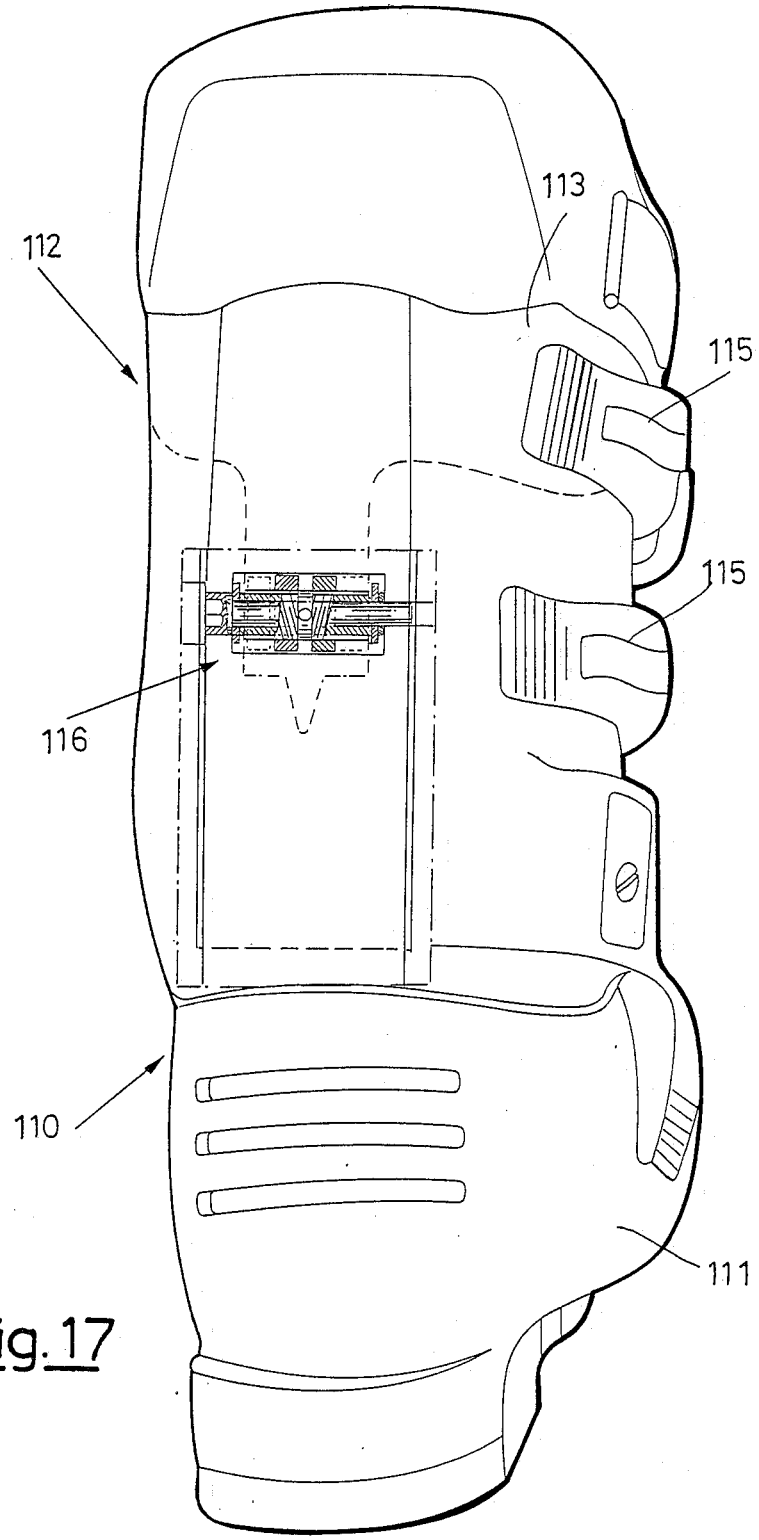
FIG. 17 is a perspective view of a further preferred embodiment of the ski boot according to the invention, as observed from the rear part.

Referring firstly to FIGS. 1-3, a ski boot is generically shown, comprising a shell 10, having a sole 11 secured thereto, and a leg portion 12, journalled on the two sides to the shell 10, so as to be inclinable forwardly, when the leg of the skier is forwardly inclined with respect to the foot, whereas it abuts rearwardly onto a step 13 formed in the shell 10.

The shell 10 is provided with a V shaped slit 14, having in a first portion diverging edges 15 and in second portion parallel edges 16 extending the edges 15.

When the leg portion of the boot is forwardly bent (see arrow 17 in FIG. 2) the opposing edges 15 and 16 of the slit 14 tend to approach to each other.

In order to mount the device according to the invention, in the leg portion 12 a rectangular seat 18 is formed which, in its central part with respect to the V shaped slit 14, has an opening or slot 19.

Considering now firstly the embodiment shown in the FIGS. 4–6 the device according to the invention comprises a pin 20, slidably housed in the slot 19 and extending as one piece with a slider 21, slidably mounted in the portion of the slit 14 defined by the parallel edges 16.

The slider 21, towards the internal part of the shell 10, has a retaining enlarged peripheral edge 22.

The pin 20, towards the outer part of the boot, has a blind hole 23 in which a wing nut 24 can be screwed, having a handle 25 to make it easier the actuation of the nut 24, the handle 25 being mounted to a platelet 26 pressing onto a tightening washer 27.

From the FIG. 4 it can be clearly observed that the slider 21 is easily displaceable between two end positions defined by the slot 19 and thus by the lower portion of slit 14 as individuated by the edges 16.

For the displacement it is enough to loose the wing nut, to manually displace the pin 20 with the related slider 21, and then to tighten again the wing nut into the desired position.

If required spring means (not shown) can be provided opposing an accidental and undesired unscrewing of the wing nut.

Considering now the embodiment shown in the FIGS. 7–10, it comprises (as in the previous embodiment) a pin 20 a the slider 21.

The pin 20 in this case is rigidly connected to a slide 28, slidably housed in a vertical guide formed by the two internal wings 29 of a sleeve 30, housed in the rectangular seat 18.

The slide 28 is provided with a threaded through hole 31, with which a correspondingly threaded screw 32 cooperate, the latter being rotatably anchored to the upper end of the sleeve 30, by means the of the unthreaded stem appendix 33 and of the rotation bearing 34.

Obviously the sleeve 30 has a bracket projection 35 corresponding to the stem 33.

The lower limit of the displacement of the slide 28, corresponding to the lower end of the slot 19, is formed by a fixed platelet 36, cross-wise anchored to the sleeve 30 and provided with a through hole through which the unthreaded portion 37 of the screw 32 passes in a freely rotatable manner, said portion 37 being rigidly anchored to an actuating roller 38, preferably having an outer knurled surface to promote the grip.

In the shown embodiment the unthreaded portion 37 passes within a coaxial hole formed in the roller 38 and is blocked by means of a dowel 39.

A lower bracket 40 formed as a one piece with the sleeve 30 fulfills the functions of supporting and centering the screw 32.

The operation of this embodiment of the device according to the invention is evident from the FIGS. 7–11.

In order to displace the slider 21 along the lower part of the slit 14, it is sufficient to rotate the roller 38 around it axis: in this manner the screw 32 is rotated, along which the slide 28, which can not rotate thanks to the sliding guide 41 cooperating with the shaped projection 42, is compelled to vertically translate, whereby the pin 20 and the slider 21 are displaced.

If desired an accidental rotation of the roller 38 can be prevented by contrasting springs (not shown and of well known type).

Turning now to consider the third embodiment shown in the FIGS. 11–13, the slider 21 and the pin 20 are connected to a slide 43, which is vertically slidable in a sliding guide 44, from which two shoulders 45 provided with holes 46 at regular and predermined intervals symmetrically protrude.

To the slide 43 there is mounted, by means of two brackets 47 and of a pin 48, a blocking lever 49, having a first arm 50 and acting as an actuating handle and a second arm 51 connected to a contrasting spring 52 having the hereinafter indicated purpose.

From the arm 50 teeth 53 are symmetrically protruding, which are adapted to engage the holes 46, the spring 52 having the function of opposing an accidental disengagement of the teeth 53 from the holes 56. Moreover the teeth 53 have a rectangular trapeze shape, whereby the rear inclined surface promotes the engagement of the teeth into the holes, whereas the fore right surface opposes a resistance, with the help of a spring 52 as already stated, to an accidental disengagement.

By raising the arm 50 of the lever 49 the teeth 53 are disengaged from the respective holes 46 and it is possible to manually displace the slide 43 along the guide 44 up to the desired position. By returning the arm 50 to the normal position, the lever 49 and consequently the slide 43 are blocked in the novel desired position.

As already mentioned the FIGS. 14, 15 and 16 show a variation of the embodiment of the FIGS. 4, 5 and 6.

In this case the slider comprises an essentially cylindrical portion 221 which is slidably seated into the slit 14, and a portion 222 having square cross-section (see FIG. 16).

This portion is slidably housed in a guide 223, in turn housed in the slot 19 and forming a step 224.

From the FIG. 16 it is clearly seen that the coupling between the portion 222 and the guide 223 prevents the portion 222 from rotating and consequently the whole slider from rotating around its axis. In the slider a threaded axial hole 225 is formed within which the pin 226, protruding from a cylindrical tail portion 227 is screwed, the latter being rigidly connected to a blocking circular plate 228 to which a cylindrical block 229 is anchored; from the latter two brackets 230 are projecting to which, by means of the pin 231, an actuating lever 232 is secured. Between the step 224 and the blocking plate 228 the Belleville washers 233 are housed.

For the sliding motion of the slider (221, 222) also the block 229 is slidably guided within the guide 234 provided in the fixture 235 secured into the seat 18 of the leg portion 12.

Referring to the above embodiment and particularly to that of the FIGS. 4–6, it is clear that in this variation means are provided such as a rigid coupling 222, 223, preventing the slider and the related pin from oscillating within the slot, and means as the Belleville washers 233 permitting the lever 232 to be oriented so as to be aligned with the seat provided within the leg portion, without any consequence on the blocking of the slider in the desired position, since the expansion of the springs with washer 233 permits even tolerances to be recovered.

Referring now to the further embodiment of the invention shown in FIGS. 17 to 20, there is shown a ski boot 110 comprising a shell 111 and a leg portion 112 hinged to the shell into two positions horizontally aligned and opposed. The leg portion 112, as it is usual in the boots with front entry, is divided into two half-leg portions, according to a division plane which is essentially vertical, the front half-leg portion (not shown) being retractable with respect to the rear one and capable of being blocked thereto by means of the usual locking hooks 115.

Figure 18:
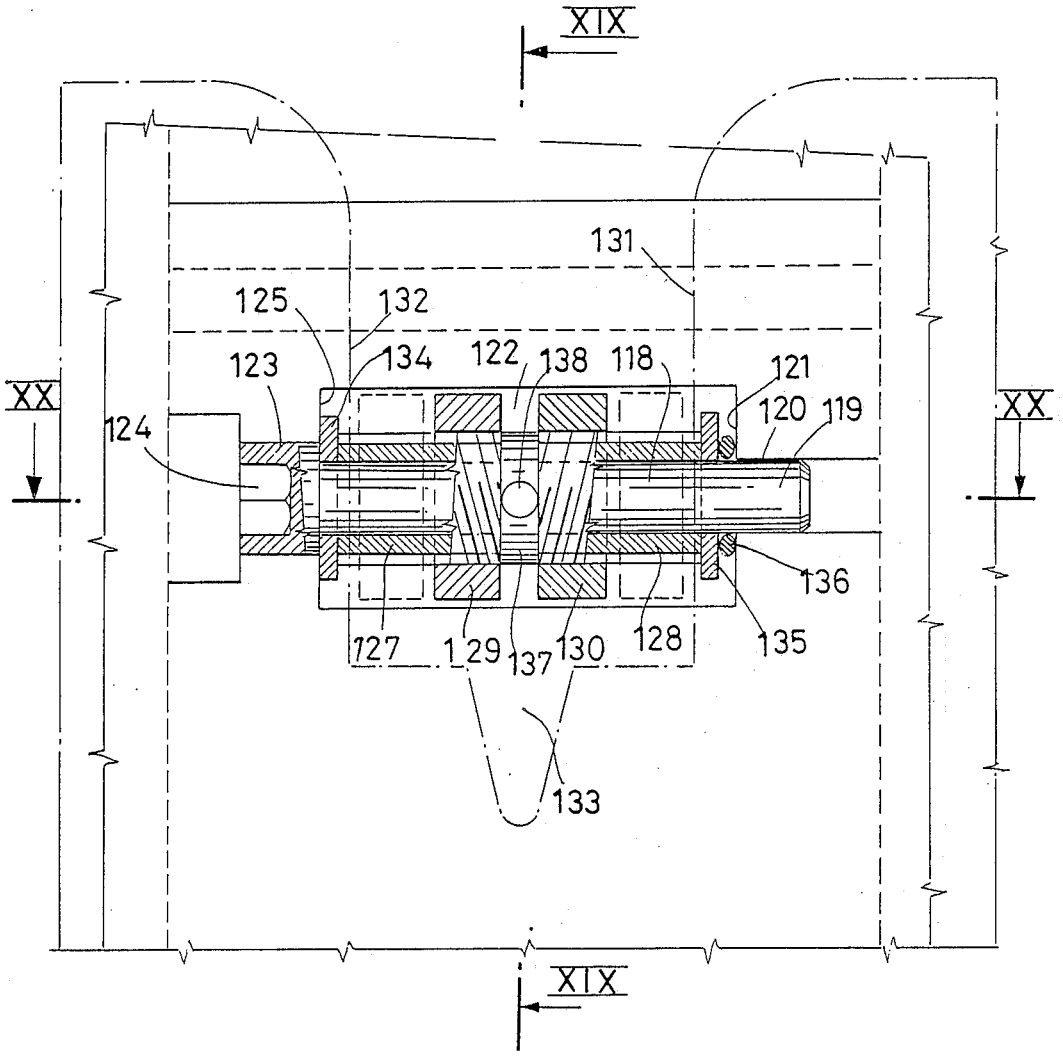
FIG. 18 is a view in an enlarged scale of the rear portion of the ski boot of the embodiment of FIG. 17 in which the adjustment device according to the present invention is housed, it being shown partially in a cross-section
Figure 19:
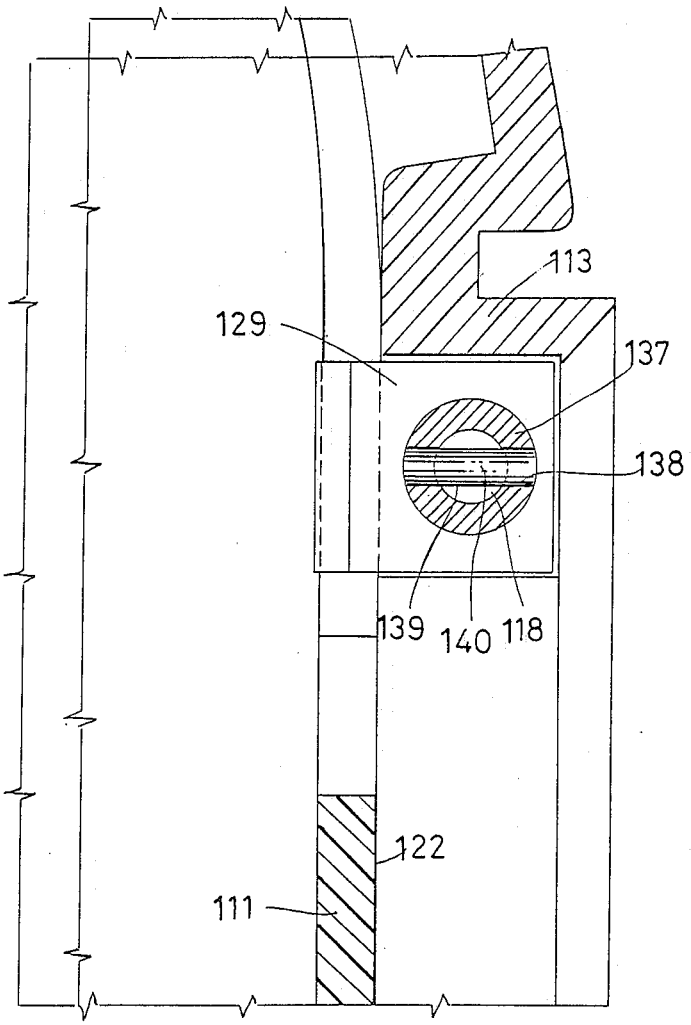
FIGS. 19 and 20 are cross-section views respectively according to the lines XIX—XIX and XX—XX of FIG. 18.
Figure 20:
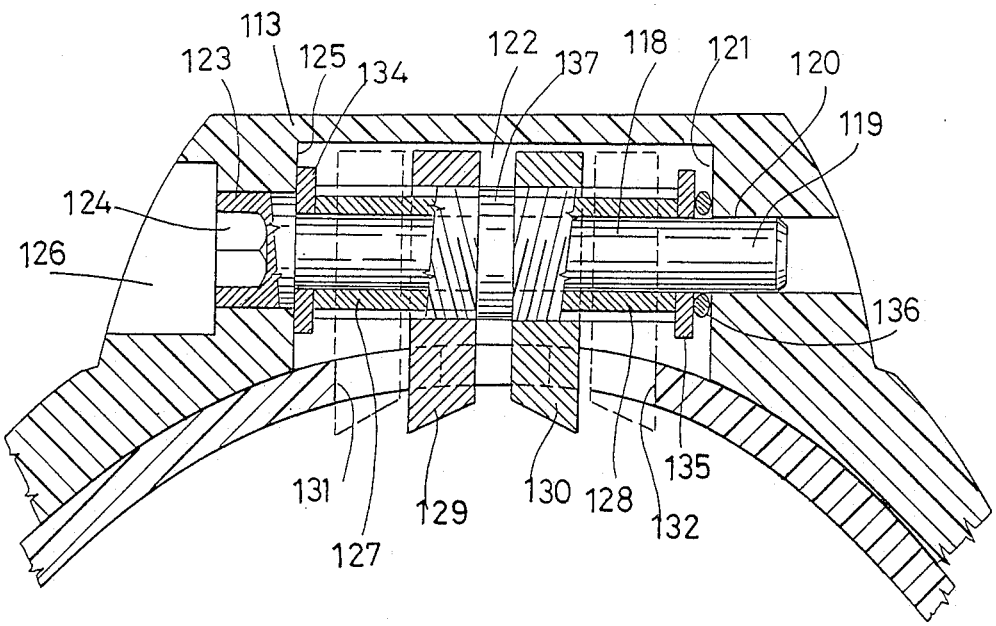

For the adjustment of the forward flexibility of the leg portion a device is foreseen, as indicated generically and on the whole by the reference 116, which is more specifically illustrated in the FIGS. 18, 19, and It consists of a pin 118, having a first end 119 housed, so as to be rotatable around its axis, in a blind hole 120 formed in the shoulder 121 of a seat 122 formed in the thickness of the leg portion 113. The other end 123 of the pin 118 is shaped with a cylindrical head in which a poligonal seat 124 is formed for the actuation by means of a set screw wrench, the other end 123 being housed within a hole provided in the shoulder 125 of the seat 122 opposing to the seat in shoulder 121, said hole being into communication with the external atmosphere through an enlarged part 126 for the access to the seat 124.

To the pin 118 two sleeves (127 and 128 respectively) are rigidly and symmetrically mounted, being externally provided with threads of opposite directions, with which two corresponding blocks 129 and 130 are engaged, each having a correspondingly through true hole.

The two blocks are interposed between the opposed edges (131 and 132) of the V shaped slit 133 formed in the rear part of the shell 111.

The aforesaid sleeves abuts against the seats of the shoulders (respectivelly 125 for the sleeve 127 end and 121 for the sleeve 128) through washers 134 and 135, whereas an elastic washer 136 is interposed between the washer 135 and the seat of shoulder 121 in order to ensure the necessary recovery of possible tolerances.

In order to rigidly block the two sleeves 127 and 128 to the pin 118 a spacer 137 is provided having a through hole 138; the latter is aligned with a diametral through hole 139 of the pin 118 and a locking pin or cotter pin 140 is introduced within the holes 138 and 139.

By the way instead of two sleeves and of the spacer only one sleeve may be provided it being rigidly blocked in a per se known manner to the axial pin and having two portions, symmetrical with respect to the vertical center line, threaded with threads of opposite directions.

The operation of the device 116 is as follows: upon rotating, by means of the suitable set wrench the pin 118, the sleeves 127 and 128 are rotated therewith, whereby the blocks 129 and 130, with a screw and ratchet mechanism, are compelled to be approached or removed with respect to each other, the symmetry with respect to said rear vertical center line of the boot being maintained.

Consequently the reciprocal spacing between the edges 131 and 132 is adjusted in the precise manner and without difficulty.

From the above description it is clear that by the invention the previously mentioned problems are solved in a simple but very effective manner. Obviously to the positions of the slider graphical indicia can be associated, related to the skill of the skier and consequently to the desirable adjustment degree.

It is lastly meant that the preceding description has only exemplifying purpose and that modifications and variations, which are conceptually and mechanically equivalent, are possible and foreseeable without falling out of the scope of the invention.

We claim:

1. In a ski boot having a shell with rear, front and side portions and an uppermost terminating edge, and a leg portion hinged to the shell to provide forward flexure of the leg portion with respect to the shell, the improvement comprising at least one generally vertical opened slot extending downwardly from the terminating edge of the shell and having generally opposed vertical slot edges and wherein said slot is disposed rearwardly of the shell, and an adjusting device for externally adjusting the limit of flexure of the shell of the boot while the boot is on the foot of the wearer, said device being engagable with the edges of the slot such that when forward flexure of the leg portion takes place the slot edges move from a non-engaging opened position and approach each other to a limit adjustably set by the adjusting device and when the forward flexure of the leg portion is released, the slot edges return to the opened position, whereby the limit of flexure of the boot is adjustable.

2. Ski boot according to claim 1, characterized in that the adjusting device comprises a slider rigidly connected to a pin and which slider is slidably housed within said slot formed in the rear part of the leg portion and axially aligned therewith, said pin being rigidly connected to a slide which is movable along said slot within a seat formed in said leg portion, and control means for controlling the displacement and the locking of said slide in a desired position along said slot.

3. Ski boot according to claim 2, characterized in that said control means for controlling the displacement and locking of the slide comprises an externally threaded screw rotatably mounted and parallel to said slot, a threaded through hole formed in said slide and engaged with the external thread of said screw, and an actuating roller coaxially with and rigidly mounted to said screw.

4. Ski boot according to claim 3, characterized in that said screw is provided at both ends with pin portions rotatably mounted in opposite seats formed in a sleeve housing said seats, said sleeve having a bracket for limiting the displacement of said slide.

5. Ski boot according to claim 3, characterized in that said roller has a knurled outer surface and is provided with a through hole in which a non-unthreaded stem portion of said screw is mounted and rigidly locked by means of a dowel.

6. Ski boot according to claim 3, characterized in that means are provided for preventing the slide from rotating around the axis of the screw.

7. Ski boot according to claim 2, characterized in that said control means for controlling the displacement and locking of said slide comprises a lever pivoted to the slide and having a first actuating arm provided with teeth which are engageable with holes formed in shoulders of said slide, said lever comprising a second arm actuated by an opposing resilient means which urges the teeth towards the locking position with said holes.

8. Ski boot according to claim 7, characterized in that said arm is fulcrumed by means of a pin to two brackets rigidly connected to said slide.

9. Ski boot according to claim 1 characterized in that the adjusting device comprises a slider rigidly connected to a pin which is provided with a threaded seat in which is screwably engaged a wing nut provided with a plate for tightening engagement against said leg portion.

10. Ski boot according to claim 1, characterized in that the adjusting device comprises a slider with two portions, with one portion having an axial polygonal cross-section and is slidably engaged with a guide housed parallelly to the said slot, said guide having a step forming a seat for a spring means for tolerance recovery, said spring means being retained by a blocking plate rigidly connected to said wing nut.

11. Ski boot according to claim 10, characterized in that said spring means consist of Belleville washers.

12. Ski boot according to claim 1, wherein the said adjusting device is disposed externally of and generally laterally across the slot, said adjusting device having:

(a) a pin disposed across said slot with respective ends thereof being rotatably mounted on respective sides, and the pin having a threaded means on each side of a vertical center line of the pin with each of said threaded means having opposite direction threads thereon;

(b) two blocks, with each block having an internally threaded through hole which receives and engages a respective threaded means of said pin, and each block having an end which extends into said slot and is engagable with the respective said opposed vertical slot edges; and (c) an actuating means for manually rotating the pin; and wherein rotation of the pin causes said blocks and said ends thereof to move from or approach each other and wherein the movement of the said opposed vertical slot edges is limited by said ends so that said forward flexure of the leg portion of the boot is adjustably limited.

13. Ski boot according to claim 12, wherein the said pin has rigidly connected thereto sleeve means externally provided with threads of opposite directions and each said block is provided with a threaded through hole which is engaged with the external threads of the corresponding sleeve means.

14. Ski boot according to claim 12, wherein the said actuating means comprise a head end of said pin having a means for the engagement of a tool for turning the pin, said half-leg portion being provided with a passage for the introduction of said tool.

15. Ski boot according to claim 13, wherein said sleeve means comprise two sleeves spaced by a spacer for the mounting to the pin.

16. Ski boot according to claim 15, wherein between at least one said sleeves and a said mountings of said seat spring means are provided for the tolerance recovery.

* * * * *